US012729926B2

(12) United States Patent
Springer et al.

(10) Patent No.: US 12,729,926 B2
(45) Date of Patent: Sep. 8, 2026

(54) ARCHERY RELEASE ASSEMBLY AND METHOD OPERABLE TO GENERATE AN OUTPUT

(71) Applicant: Copper John Corporation, Auburn, NY (US)

(72) Inventors: Eric C. Springer, Moravia, NY (US); Joel P. Turner, Eatonville, WA (US)

(73) Assignee: COPPER JOHN CORPORATION, Auburn, NY (US)

( * ) Notice: Subject to any disclaimer, the term of this patent is extended or adjusted under 35 U.S.C. 154(b) by 51 days.

(21) Appl. No.: 18/613,767

(22) Filed: Mar. 22, 2024

(65) Prior Publication Data

US 2024/0318936 A1 Sep. 26, 2024

Related U.S. Application Data

(60) Provisional application No. 63/454,483, filed on Mar. 24, 2023.

(51) Int. Cl.
*F41B 5/14* (2006.01)

(52) U.S. Cl.
CPC ..... *F41B 5/1469* (2013.01)

(58) Field of Classification Search
CPC ..... F41B 5/1469
USPC ..... 124/86
See application file for complete search history.

(56) References Cited

U.S. PATENT DOCUMENTS 228,302 A 6/1880 Beard
229,089 A 6/1880 Burnham
2,819,707 A 1/1958 Kayfes et al.
3,009,454 A 11/1961 Graham
3,656,467 A 4/1972 Halter
3,757,763 A 9/1973 Pinti et al.
3,768,456 A 10/1973 Hansen et al.
3,853,111 A 12/1974 Stanislawski et al.
3,921,668 A 11/1975 Self
3,942,507 A 3/1976 Opal
3,954,095 A 5/1976 Lewis
3,965,884 A 6/1976 Killian
4,036,204 A 7/1977 Scott
4,041,926 A 8/1977 Troncosco, Jr. et al.
4,066,060 A 1/1978 Napier
4,160,437 A 7/1979 Fletcher
4,282,851 A 8/1981 Lyons
4,305,208 A 12/1981 Larson
4,391,263 A 7/1983 Dodge
(Continued)

OTHER PUBLICATIONS

Bow Lock downloaded from http://www.archery history.com/releases/releasespics/release5.jpg on Dec. 23, 2009.
(Continued)

*Primary Examiner* — John E Simms, Jr.
(74) *Attorney, Agent, or Firm* — Barclay Damon LLP

(57) ABSTRACT

An archery release assembly, in an embodiment, includes a body, a trigger supported by the body, a trigger controller supported by the body, and a draw cord holder supported by the body. The trigger and trigger controller are each pivotal relative to the body. The trigger controller includes a step-shaped portion The trigger and the trigger controller are configured to cooperate to generate an output as a result of a part of the trigger striking or coming into contact with the step-shaped portion of the trigger controller.

20 Claims, 12 Drawing Sheets

(56) References Cited

U.S. PATENT DOCUMENTS

| | | | | |
|---|---|---|---|---|
| 4,392,475 | A | 7/1983 | Fletcher | |
| 4,407,260 | A | 10/1983 | Lyons | |
| 4,424,791 | A | 1/1984 | Muehleisen | |
| 4,426,989 | A | 1/1984 | Sutton | |
| 4,466,418 | A | 8/1984 | Jones | |
| 4,498,448 | A | 2/1985 | Fletcher | |
| 4,509,497 | A | 4/1985 | Garvison | |
| 4,539,968 | A | 9/1985 | Garvison | |
| 4,567,875 | A | 2/1986 | Fletcher | |
| 4,569,744 | A | 2/1986 | Walker | |
| 4,574,767 | A | 3/1986 | Gazzara | |
| 4,584,747 | A | 4/1986 | Katterbach et al. | |
| 4,600,622 | A | 7/1986 | Carlson et al. | |
| 4,607,947 | A | 8/1986 | Ensing et al. | |
| 4,612,907 | A | 9/1986 | Gantt | |
| 4,620,523 | A | 11/1986 | Peck | |
| 4,625,705 | A | 12/1986 | Willits | |
| 4,672,945 | A | 6/1987 | Carlton | |
| 4,674,469 | A | 6/1987 | Peck | |
| 4,831,997 | A | 5/1989 | Greene | |
| 4,854,293 | A | 8/1989 | Roberts | |
| D303,420 | S | 9/1989 | Huber | |
| 4,881,516 | A | 11/1989 | Peck | |
| 4,887,583 | A | 12/1989 | Lin | |
| 4,930,485 | A | 6/1990 | Kopper | |
| 4,949,698 | A | 8/1990 | Burnham | |
| 4,981,128 | A | 1/1991 | Garvison | |
| 4,982,718 | A | 1/1991 | Hamm et al. | |
| 5,009,214 | A | 4/1991 | Wilde | |
| 5,025,772 | A | 6/1991 | Stevenson | |
| 5,056,498 | A | 10/1991 | Scherz | |
| 5,056,586 | A | 10/1991 | Bemisderfer | |
| 5,067,472 | A | 11/1991 | Vogel et al. | |
| 5,092,053 | A | 3/1992 | Roberts | |
| 5,184,596 | A | 2/1993 | Green et al. | |
| 5,205,268 | A | 4/1993 | Savage | |
| 5,215,504 | A | 6/1993 | Wong et al. | |
| 5,224,463 | A | 7/1993 | Townsend | |
| 5,247,922 | A | 9/1993 | Lalonde | |
| 5,261,581 | A | 11/1993 | Harden | |
| 5,273,021 | A | 12/1993 | Tepper | |
| 5,307,966 | A | 5/1994 | Inaba et al. | |
| 5,323,754 | A | 6/1994 | Pittman et al. | |
| 5,424,813 | A | 6/1995 | Schlueter et al. | |
| 5,448,983 | A | 9/1995 | Scott | |
| 5,460,721 | A | 10/1995 | Goodwin | |
| 5,481,807 | A | 1/1996 | Ploot | |
| 5,546,924 | A | 8/1996 | Todd | |
| 5,554,329 | A | 9/1996 | Monkelbaan et al. | |
| 5,595,167 | A | 1/1997 | Scott | |
| 5,596,977 | A | 1/1997 | Scott | |
| 5,615,662 | A | 4/1997 | Tentler et al. | |
| 5,653,214 | A | 8/1997 | Lynn | |
| 5,685,286 | A | 11/1997 | Summers | |
| 5,692,490 | A | 12/1997 | Walker | |
| 5,694,915 | A | 12/1997 | Summers | |
| 5,702,494 | A | 12/1997 | Tompkins et al. | |
| 5,765,536 | A | 6/1998 | Scott | |
| 5,779,904 | A | 7/1998 | Ruderman et al. | |
| 5,803,068 | A | 9/1998 | Summers | |
| 5,842,916 | A | 12/1998 | Gerrity et al. | |
| 5,850,825 | A | 12/1998 | Scott | |
| 5,934,679 | A | 8/1999 | Strain et al. | |
| 5,937,841 | A | 8/1999 | Summers et al. | |
| 5,937,842 | A | 8/1999 | Summers et al. | |
| 5,941,225 | A | 8/1999 | Tentler et al. | |
| 6,032,661 | A | 3/2000 | Goff et al. | |
| 6,302,093 | B1 | 10/2001 | Holland | |
| 6,460,529 | B2 | 10/2002 | Pullin | |
| 6,478,020 | B1 | 11/2002 | Rentz | |
| 6,481,430 | B1 | 11/2002 | Lightcap, Jr. | |
| 6,481,431 | B1 | 11/2002 | Summers | |
| 6,508,005 | B2 | 1/2003 | Springer | |
| 6,567,593 | B1 | 5/2003 | Sugawara | |
| 6,571,786 | B2 | 6/2003 | Summers et al. | |
| 6,584,966 | B1 | 7/2003 | Summers et al. | |
| 6,606,984 | B2 | 8/2003 | Mugg | |
| 6,631,709 | B2 | 10/2003 | Carter et al. | |
| 6,647,976 | B2 * | 11/2003 | Summers | F41B 5/1469 124/35.2 |
| 6,659,378 | B2 | 12/2003 | Di Anna | |
| 6,736,124 | B2 | 5/2004 | Carter | |
| 6,763,819 | B2 | 7/2004 | Eckert | |
| 6,796,037 | B1 | 9/2004 | Geffers et al. | |
| 6,895,951 | B2 | 5/2005 | Summers et al. | |
| 6,925,996 | B1 | 8/2005 | Todd | |
| 6,945,241 | B2 | 9/2005 | Pellerite | |
| 6,953,035 | B1 | 10/2005 | Summers et al. | |
| 6,957,644 | B2 | 10/2005 | Simo et al. | |
| D546,916 | S | 7/2007 | Schwerman et al. | |
| 7,278,415 | B2 | 10/2007 | Jones | |
| D558,915 | S | 1/2008 | Kakuno et al. | |
| 7,325,539 | B2 | 2/2008 | Simo et al. | |
| D597,164 | S | 7/2009 | Jones | |
| 7,574,999 | B2 | 8/2009 | Pardoski, Jr. | |
| 7,581,536 | B2 | 9/2009 | Porter | |
| 7,603,784 | B2 | 10/2009 | Erhard | |
| 7,654,254 | B1 | 2/2010 | Rentz et al. | |
| 7,753,043 | B1 | 7/2010 | Eckert | |
| 7,926,475 | B2 | 4/2011 | Jones | |
| 7,946,282 | B2 | 5/2011 | Jones | |
| 8,082,910 | B1 | 12/2011 | Yehle | |
| 8,146,578 | B2 | 4/2012 | Jones | |
| 8,161,956 | B2 | 4/2012 | Bednar | |
| 8,622,051 | B2 | 1/2014 | Summers | |
| 8,869,781 | B2 | 10/2014 | Jones | |
| 9,027,540 | B2 | 5/2015 | Springer | |
| 9,982,961 | B1 * | 5/2018 | Rentz | F41B 5/1469 |
| 11,112,206 | B1 * | 9/2021 | Jones | F41B 5/1469 |
| 11,353,281 | B1 * | 6/2022 | Rentz | F41B 5/1469 |
| 2003/0037778 | A1 | 2/2003 | Carter et al. | |
| 2003/0154969 | A1 | 8/2003 | Carter | |
| 2003/0159682 | A1 | 8/2003 | Pellerite | |
| 2003/0230295 | A1 | 12/2003 | Jones | |
| 2004/0079351 | A1 | 4/2004 | Summers et al. | |
| 2005/0183272 | A1 | 8/2005 | Meadows | |
| 2007/0181113 | A1 * | 8/2007 | Porter | F41B 5/1469 124/35.2 |
| 2007/0277471 | A1 | 12/2007 | Gibson | |
| 2008/0149084 | A1 | 6/2008 | Whalen et al. | |
| 2008/0251059 | A1 | 10/2008 | McPherson | |
| 2008/0282560 | A1 | 11/2008 | Bradley et al. | |
| 2009/0056689 | A1 * | 3/2009 | Jones | F41B 5/1469 124/1 |
| 2009/0064978 | A1 | 3/2009 | Matasic et al. | |
| 2009/0090342 | A1 | 4/2009 | Freitag et al. | |
| 2009/0095270 | A1 | 4/2009 | Graves | |
| 2009/0159395 | A1 | 6/2009 | Gerrity et al. | |
| 2009/0185868 | A1 | 7/2009 | Masters et al. | |
| 2010/0064535 | A1 | 3/2010 | Kingsbury | |
| 2010/0071909 | A1 | 3/2010 | Winn | |
| 2010/0108047 | A1 | 5/2010 | Jones | |
| 2011/0144639 | A1 | 6/2011 | Govari | |
| 2011/0162669 | A1 | 7/2011 | Kurek et al. | |
| 2011/0168146 | A1 * | 7/2011 | Deceuster | F41B 5/1469 124/80 |
| 2012/0192844 | A1 | 8/2012 | Springer | |
| 2012/0285431 | A1 | 11/2012 | Summers | |
| 2013/0025578 | A1 | 1/2013 | Jones | |
| 2013/0092140 | A1 | 4/2013 | Rentz | |
| 2018/0164067 | A1 * | 6/2018 | Springer | F41B 5/1469 |

OTHER PUBLICATIONS

Various prior art releases (1) downloaded from http://www.archeryhistory.com/releases/releasespics/pse.jpg, on Dec. 23, 2009.

Various prior art releases (2) http://www.archeryhistory.com/releases/releasespics/release4.jpg on Dec. 23, 2009.

Mamba R1 Swing Away E-Z Adjust downloaded from http://www.cobraarchery.com/c569.html, on Mar. 10, 2010.

Prior art releases (3) downloaded from http://www.archerhistory.com/releases on Jul. 21, 2011.

(56) References Cited

OTHER PUBLICATIONS

Prior art releases (4) downloaded from http://www.archerhistory.com/releases on Jul. 21, 2011.
Longhorn Hunter (2010).

* cited by examiner

ARCHERY RELEASE ASSEMBLY AND METHOD OPERABLE TO GENERATE AN OUTPUT

CROSS-REFERENCE TO RELATED APPLICATION

This application is a non-provisional of, and claims the benefit and priority of, U.S. Provisional Patent Application No. 63/454,483, filed on Mar. 24, 2023. The entire contents of such application are incorporated herein by reference.

BACKGROUND

Archers use archery release aids to hold a bowstring in the drawn position. The known release aids attach to the bowstring and enable the archer to pull the bowstring to the drawn position. The user activates the release aid, either by activating a trigger or by jerking the release, to cause the bowstring to slide off of the release aid's hook, thereby enabling the bowstring to propel an arrow toward a target.

There are known release aids that include a release case, a hook and one or more linkage components coupled to the hook. Some of the known release aids have triggers coupled to the linkage components.

The release aid described in U.S. Pat. No. 8,622,051, shown in FIG. 1, produces a sound when the release is actuated to release the bowstring from the hook 10. As shown, this release aid includes a sear 6 that cooperates with an edge 10*a* of the hook 10 to produce the sound. This configuration of this known release aid has several disadvantages. Notably, this configuration results in relatively high load forces on the interfacing elements, such as the sear 6 and the hook 10, that produce the sound. These load forces result in faster wear rates and a shorter lifespan of these components and limited design flexibility of the archery release aid itself. Furthermore, there is a delay between the point in time when the user activates the release aid and when the sound occurs. This known release aid produces the sound at the front part of the aid, a part located further from the user than other parts of the release aid. Consequently, this configuration can undesirably prolong this delay, which can frustrate the user's efforts to use the sound for helpful feedback during the shooting process.

The foregoing background describes some, but not necessarily all, of the problems, disadvantages and shortcomings related to the known archery release aids.

SUMMARY

To be updated upon approval of the claims

BRIEF DESCRIPTION OF THE DRAWINGS

So that the manner in which the features of the disclosure can be understood, a detailed description may be had by reference to certain embodiments, some of which are illustrated in the accompanying drawings. It is to be noted, however, that the drawings illustrate only certain embodiments and are therefore not to be considered limiting of its scope, for the scope of the disclosed subject matter encompasses other embodiments as well. The drawings are not necessarily to scale, emphasis generally being placed upon illustrating the features of certain embodiments. In the drawings, like numerals are used to indicate like parts throughout the various views, in which.

DETAILED DESCRIPTION

Throughout this disclosure set forth herein, the word "including" indicates or means "including, without limitation," the word "includes" indicates or means "includes, without limitation," the phrases "such as" and "e.g." indicate or mean "including, without limitation," and the phrase "for example" refers to a non-limiting example.

Figure 2:
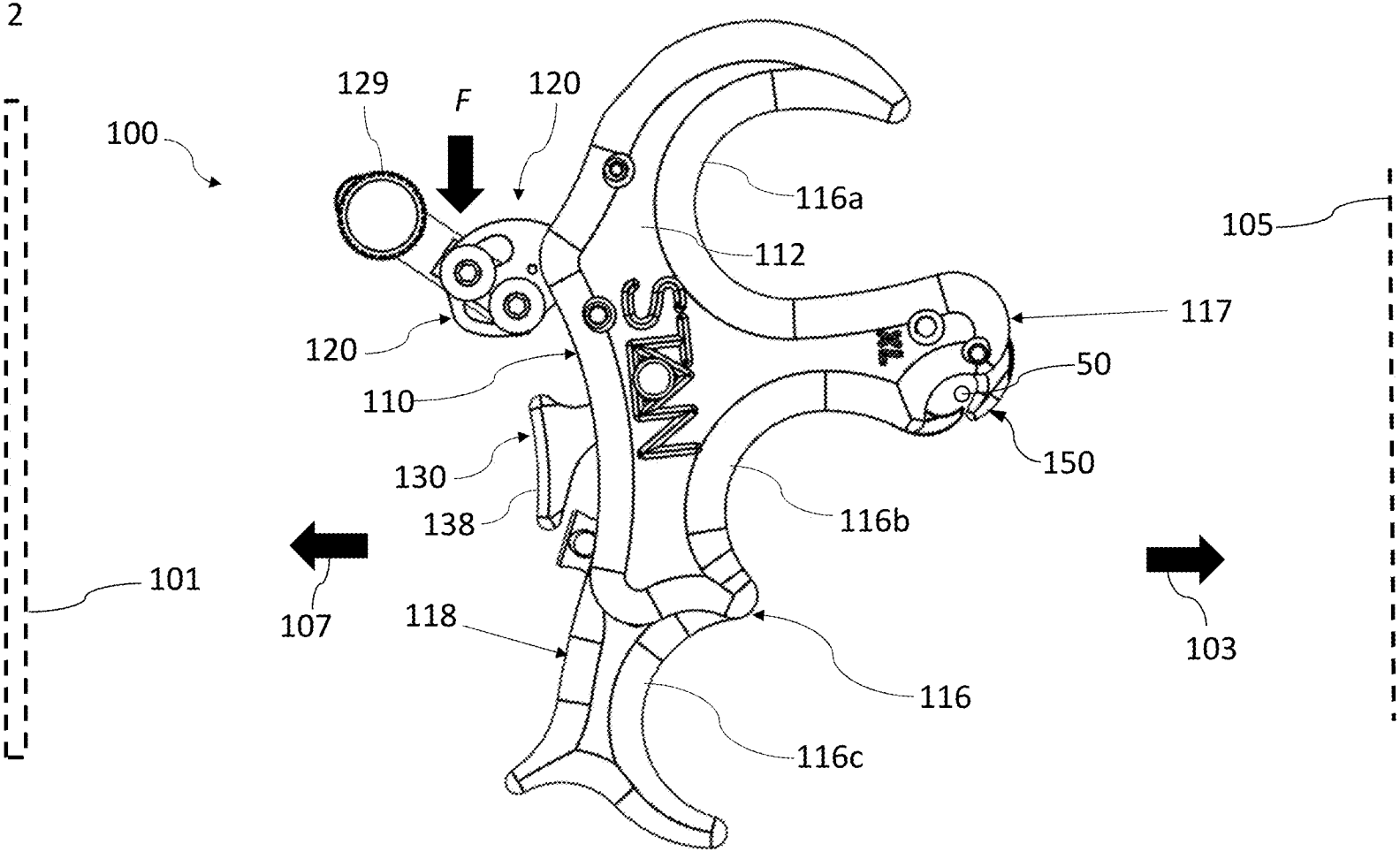
FIG. 2 is a right side view of an embodiment of an archery release assembly according to the following disclosure, illustrating the archery release assembly in a vertical orientation when the archery release assembly is aimed at a shooting target.
Figure 3:
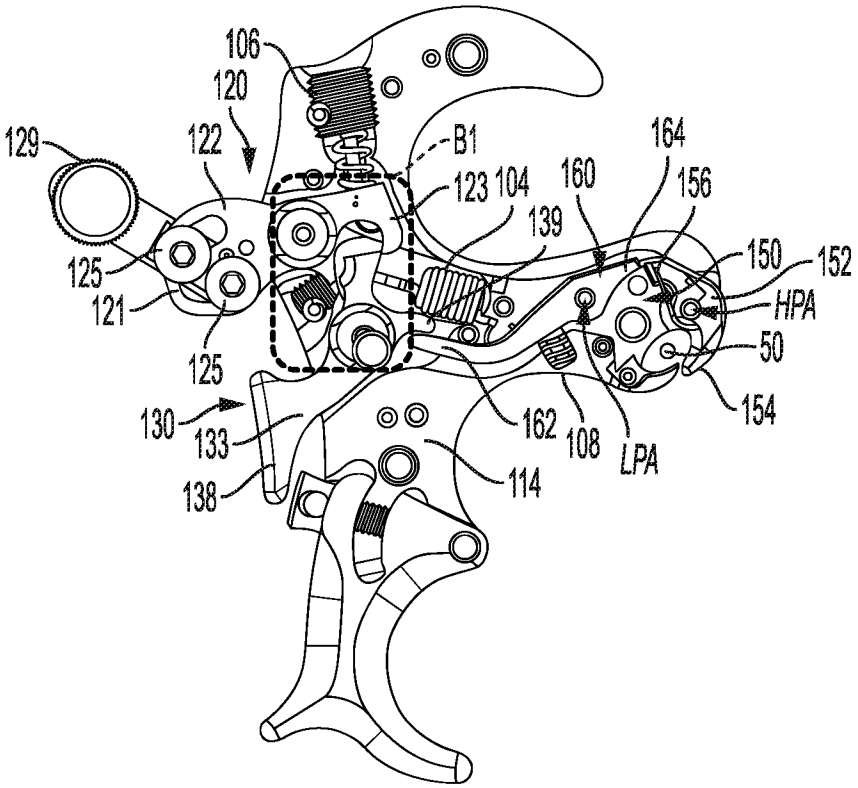
FIG. 3 is a right side view of the embodiment of FIG. 2 with the right side of the housing removed, illustrating the archery release assembly in a vertical orientation when the archery release assembly is aimed at a shooting target.

As illustrated in FIGS. 2 and 3 in an embodiment, an archery release assembly 100 is usable by an archer or user 101 to retract and release a bowstring or draw cord 50 of an archery shooting device, such as an archery bow (including a compound bow, a recurve bow and a fishing bow) enabling the draw cord 50 to move in a forward direction 103 toward a shooting target 105. The forward direction 103 is opposite of the rearward direction 107. As a result of the forward movement of the draw cord 50, the draw cord 50 is configured to launch an arrow or projectile (not shown) toward the target 105. The archery release assembly 100 includes a case, housing or body 110 having a right side panel 112 and a left side panel 114 configured to be connected to, coupled to or joined with the right side panel 112. The archery release assemble 100 also includes a grasp 116 having finger interface surfaces 116*a*, 116*b*, 116*c* configured to engage or interface with a plurality of fingers of the archer or user. When joined, connected or fastened together, the side panels 112, 114 in conjunction with the grasp 116 collectively form or define a front surface 117 and a rear surface 118. When in use, the front surface 117 faces toward the target 105, and the rear surface 118 faces towards the archer or user 101 in the rearward direction 107.

Figure 4:
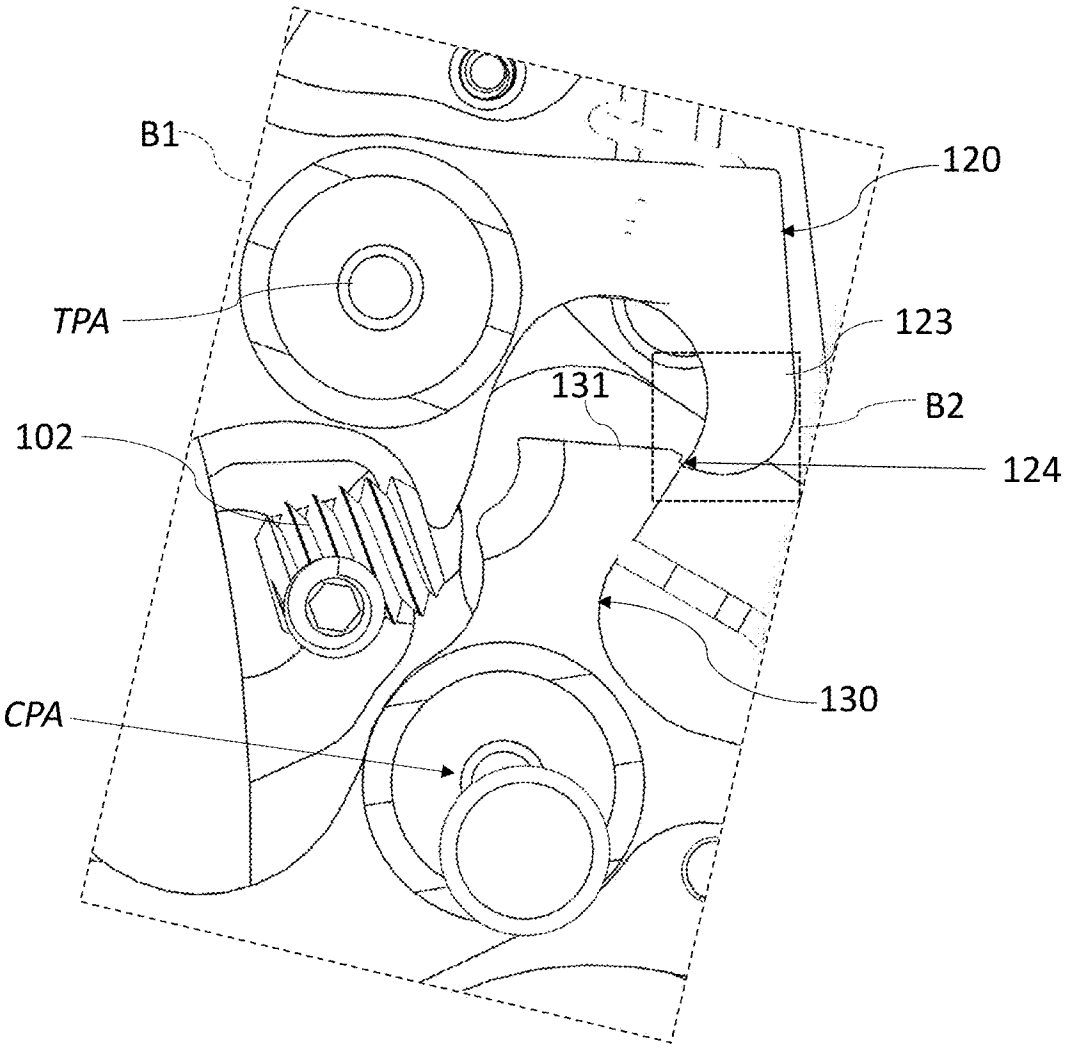
FIG. 4 is a close-up, enlarged view of section B1 of the embodiment of FIG.
Figure 5:
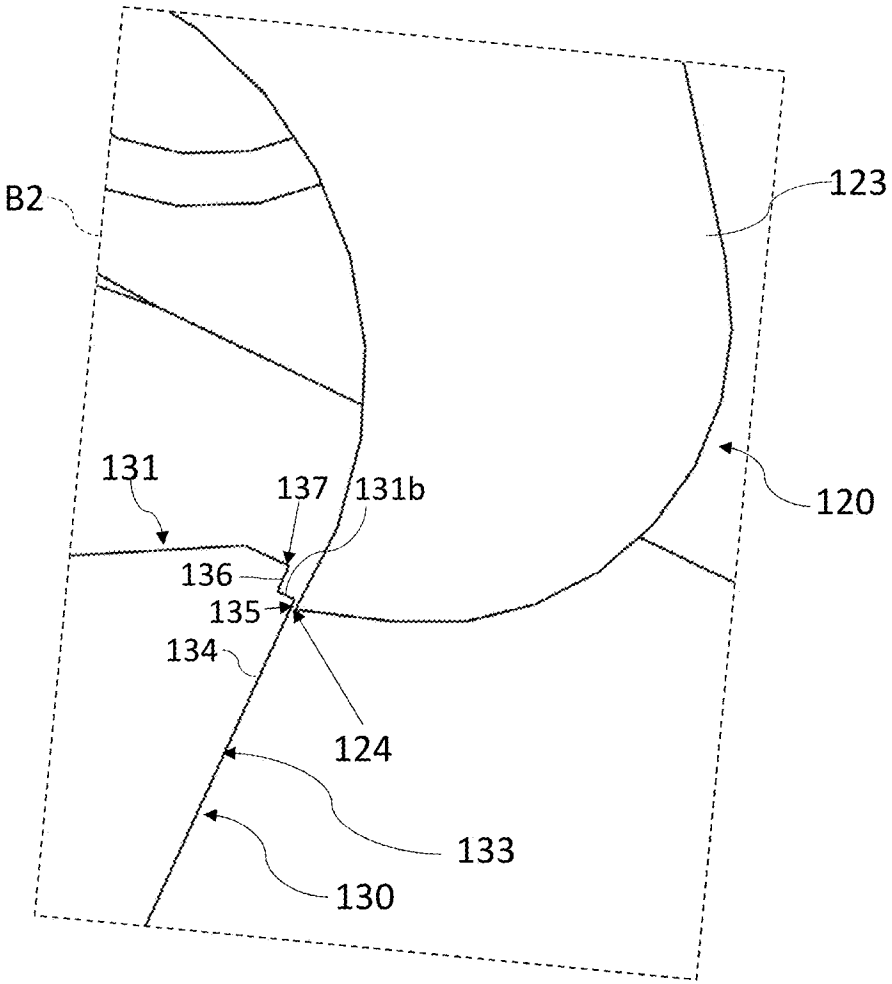
FIG. 5 is a close-up, enlarged view of section B2 of the embodiment of FIG.
Figure 6:
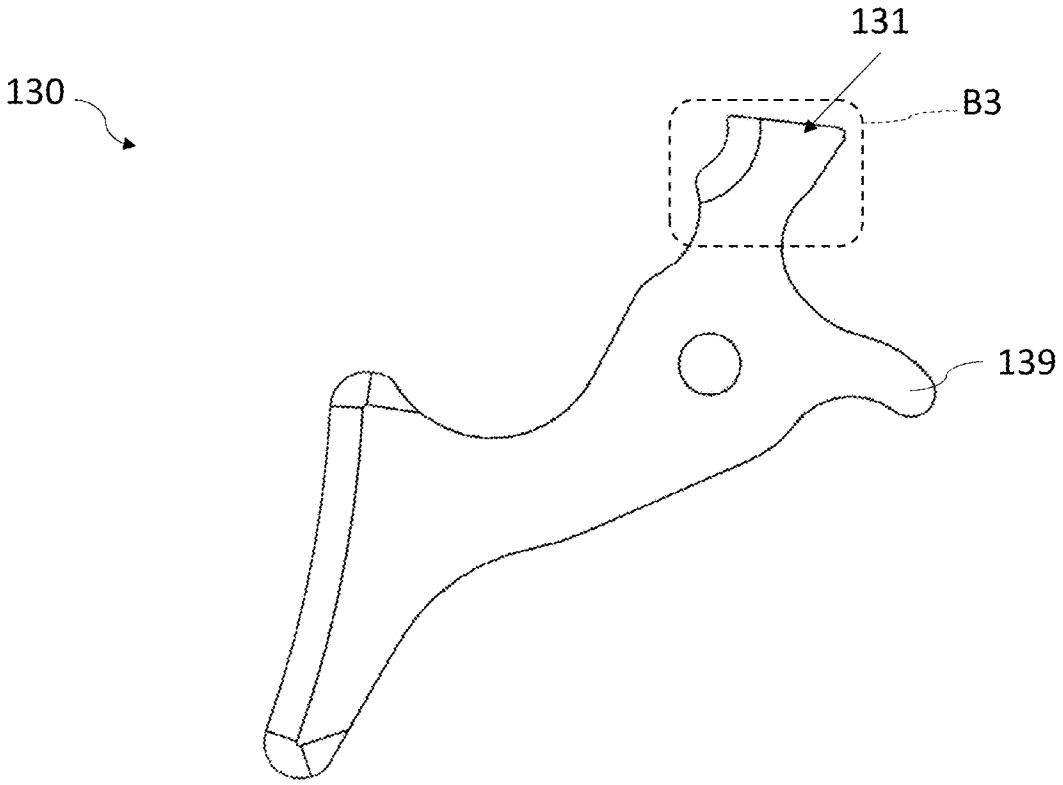
FIG. 6 is a side view of an embodiment of the trigger controller removed from the archery release assembly of FIG. 3.
Figure 7:
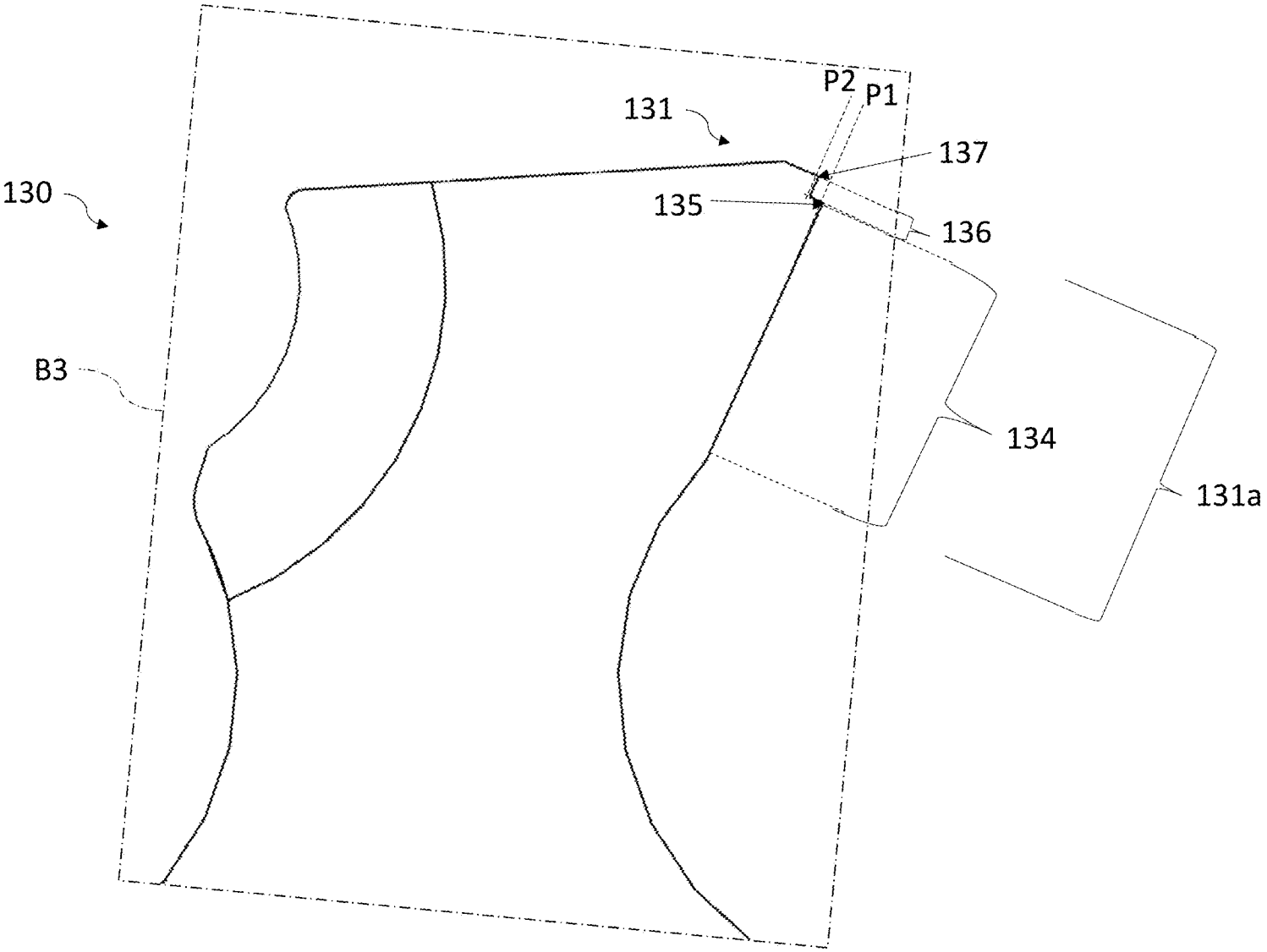
FIG. 7 is a close-up, enlarged view of area B3 of the embodiment of FIG.

As shown specifically in FIGS. 2, 3 and 4, in the illustrated embodiment, the archery release assembly 100 includes a trigger 120 pivotally coupled to the body 110. The trigger 120 includes a trigger body 122 extending from a first trigger end 121 to a second trigger end 123. The first trigger end 121 is configured to be coupled to a thumb support or trigger grasp 129. In an embodiment, the thumb grasp 129 is configured to receive a trigger input or force from the user. The second trigger end 123 includes a trigger portion or trigger edge 124 that pivots about a trigger pivot axis TPA in response to a force applied to the trigger 120 by the user. As shown in FIG. 4, the trigger edge 124 pivots in a counterclockwise direction in response to a downward force F (see FIG. 2) applied to the trigger 120 by the user when transitioning the archery release assembly 100 from a drawn state, non-release or cocked position to a release state or release position. The angular position of the trigger grasp 129 relative to the trigger body 122 may be configured to be adjusted via one or more trigger adjusters 125.

Turning to FIGS. 3-7, the archery release assembly 100 further includes a sear or trigger controller 130 that is pivotally coupled to the body 110 and configured to pivot about a trigger controller pivot axis CPA. The sear or trigger controller 130 includes a first trigger controller portion 131 and a second trigger controller portion 133. The first trigger controller portion 131 defines a step shape, and, in an embodiment, includes a step-shaped portion 131*a* with a first step surface 134 extending to a first step edge 135, and a second step surface 136 extending to a second step edge 137. As shown specifically in FIG. 7, the first step surface 134 and the second step surface 136 are off-set from each other and extend along different planes that are parallel to one another. In an embodiment, the step-shaped portion 131*a* includes an intermediary segment or spacer 131*b* (shown in FIG. 5) that causes the first step surface 134 to extend along a first plane P1 and the second step surface 136 to extend along a second plane P2 that is parallel to the first plane P1 and off-set from the first plane P1. The second controller portion 133 includes a positioner or cocking grasp 138 (shown in FIG. 3) that extends outside of or away from the body 110 and is accessible to, and graspable or touchable by, the user. The second controller portion 133 also has a projection, finger or protrusion 139 (shown in FIG. 3) positioned between the first trigger controller portion 131 and the cocking grasp 138.

The archery release assembly 100 further includes a bowstring holder or draw cord holder 150 that is pivotally coupled to the body 110 and includes a body 152 configured to pivot about a holder pivot axis HPA. The body 152 of the draw cord holder 150 includes a first draw cord holder portion 154 that is configured to retain a portion of the draw cord 50 when the draw cord holder 150 is in the non-release or cocked position as shown in FIGS. 2 and 3. The draw cord holder 150 also includes a second draw cord holder portion 156. As shown in FIG. 3, the holder pivot axis HPA is positioned between the first draw cord holder portion 154 and the second draw cord holder portion 156. In an embodiment, the first draw cord holder portion 154 may comprise a hook shape, an arc shape, or hook-shaped segment.

Referring to FIG. 3, the archery release assembly 100 also includes a linking member or a link 160 pivotally coupled to the body 110 and configured to pivot about a link pivot axis LPA. The link 160 includes a first link portion 162 and a second link portion 164. The first link portion 162 is configured to interact with the projection 139 of the second controller portion 133. During such interaction, the first link portion 162 is in changeable, physical contact with the projection 139. The second link portion 164 is configured to interact with the second draw cord holder portion 156 when the draw cord holder 150 is in the non-release or cocked position as shown in FIG. 3. During such interaction, the second link portion 164 is in changeable, physical contact with the draw cord holder 150. When the second link portion 164 is engaged with—in physical contact with—the draw cord holder 150, the archery release assembly 100 is in the non-release or cocked position, as shown in FIGS. 2 and 3.

Operation of the archery release assembly 100 will now be discussed with reference to FIGS. 8-12 beginning with the archery release assembly 100 in the non-release position or cocked as shown in FIGS. 2 and 3, where the draw cord holder 150 is holding or retaining a portion of the draw cord 50. Initially, the user adjusts the trigger grasp 129 and the cocking grasp 138 to cock the archery release assembly 100 or otherwise put the archery release assembly 100 in a non-release or cocked position or state. FIGS. 8-12 show a progression of the physical interaction of the first trigger controller portion 131 and the trigger edge 124 during a transition of the archery release assembly 100 from its cocked position to its release position.

Figure 8:
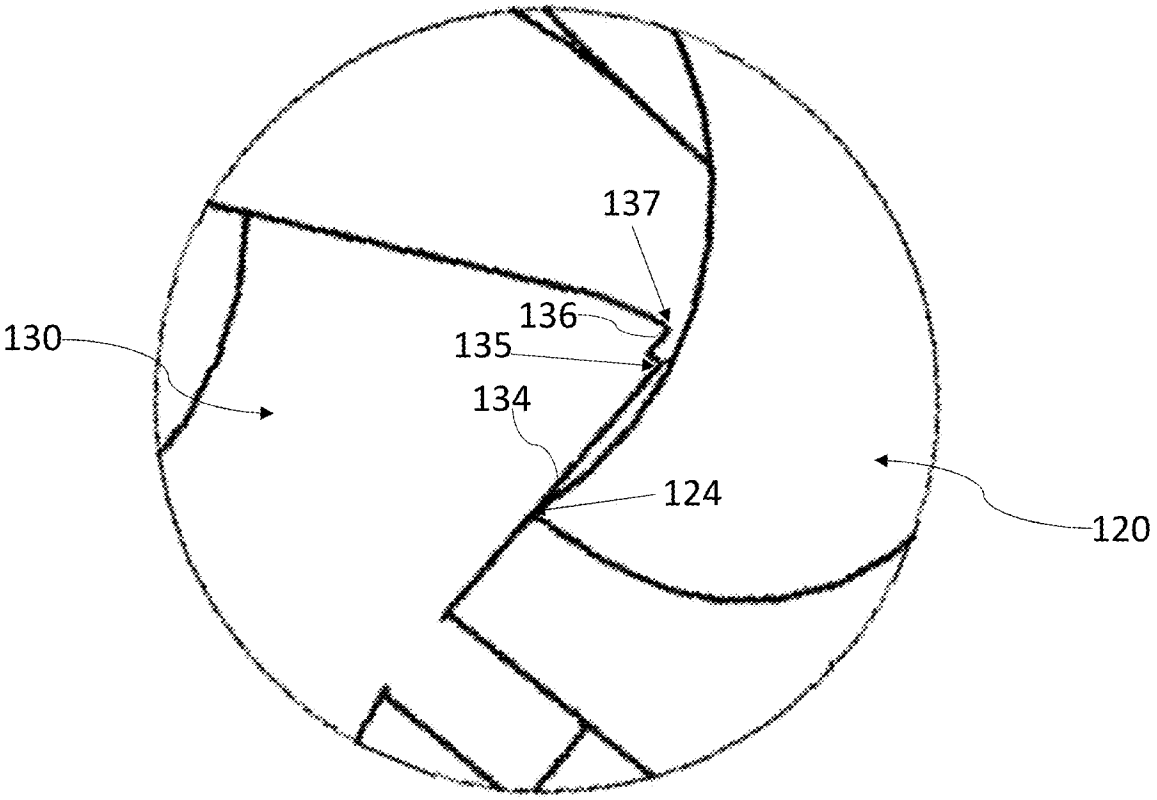
FIG. 8 is a close-up, enlarged view of a portion of the archery release assembly of FIG. 2, showing a first interaction between the trigger and the trigger controller.
Figure 9:
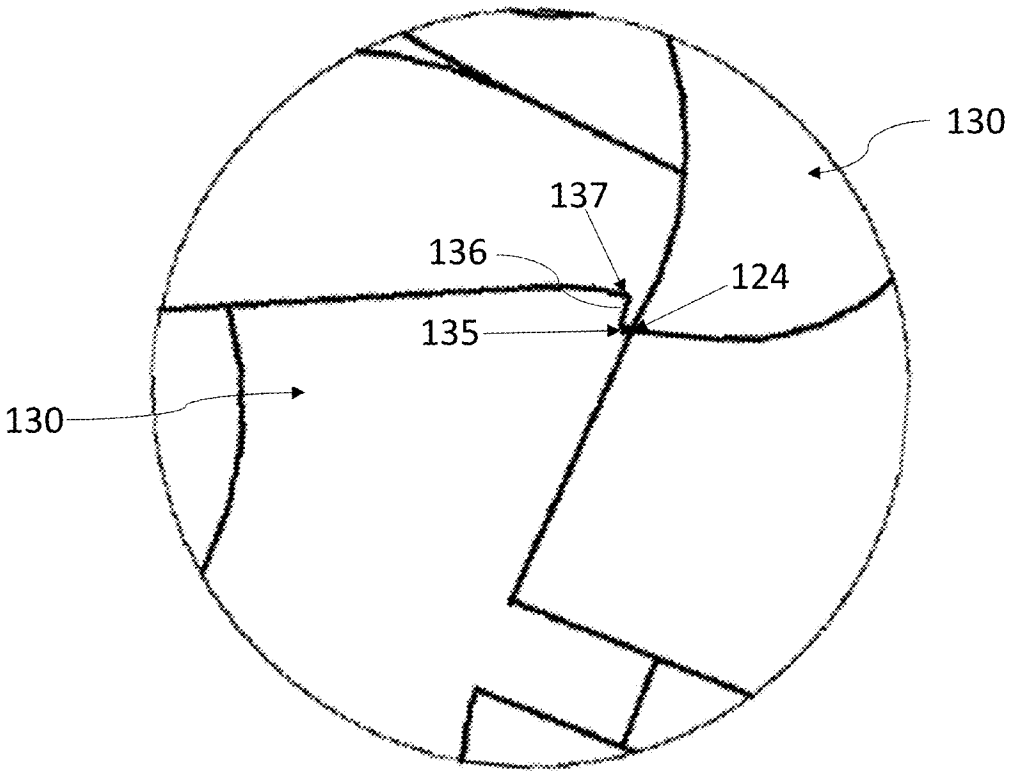
FIG. 9 is a close-up, enlarged view of a portion of the archery release assembly of FIG. 2, showing a second interaction between the trigger and the trigger controller.

Beginning with FIG. 8, in a non-release or cocked position or a first release action, the trigger 120 is positioned in a first interaction in which the trigger edge 124 is in contact or otherwise interacts with the first step surface 134 of the trigger controller 130. In this first interaction, the sear or trigger controller 130 interferes with and restricts the movement of the trigger 120, which keeps the archery release assembly 100 cocked. A second interaction or a second release action is shown in FIG. 9 where the trigger 120 is further moved to cause the trigger 120 to pivot in the counterclockwise direction to position the trigger edge 124 at the first step edge 135. In this second interaction, the sear or trigger controller 130 continues to interfere with and restrict the movement of the trigger 120, which continues to keep the archery release assembly 100 cocked.

Figure 10:
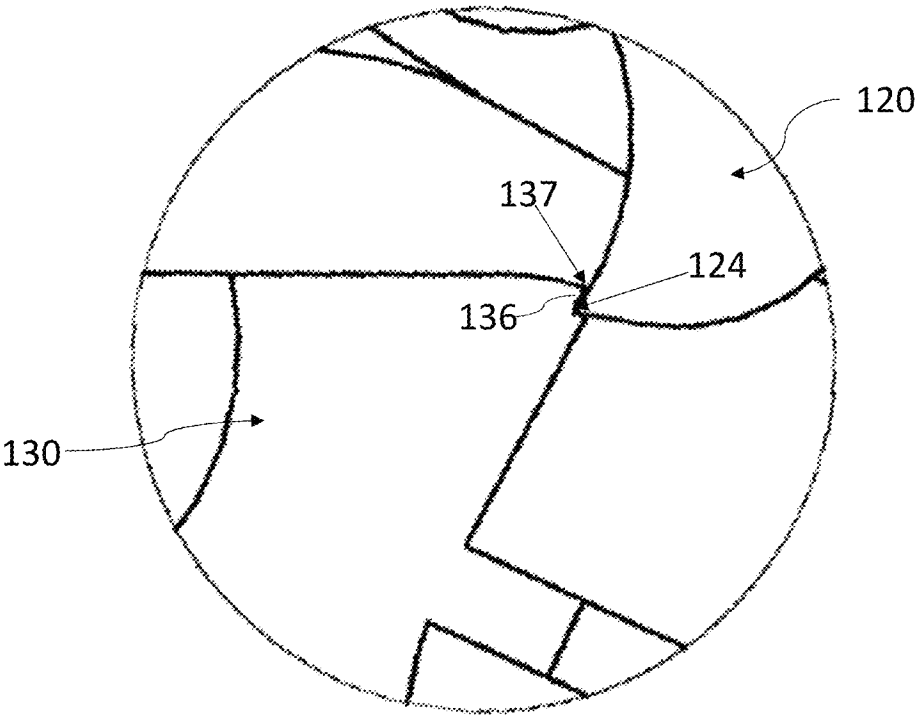
FIG. 10 is a close-up, enlarged view of a portion of the archery release assembly of FIG. 2, showing a third interaction between the trigger and the trigger controller.

A third interaction or a third release action is shown in FIG. 10 where the trigger 120 has been further moved to continue pivoting the trigger 120 counterclockwise to move the trigger edge 124 from the first step edge 135 to the second step surface 136. The movement of the trigger edge 124 from the first step edge 135 to the second step surface 136 results in the generation of an output that is perceptible to humans. In this third interaction, the sear or trigger controller 130 continues to interfere with and restrict the movement of the trigger 120, which continues to keep the archery release assembly 100 cocked.

Depending one the embodiment, the output resulting from the third interaction can include an audible output or a sound, a visual output, a vibratory output, a tactile output, or a haptic output. In an example of one embodiment, due to the trigger edge 124 striking the second step surface 136, a "click," "pop," or "snap" sound is generated as the output. In an example of another embodiment, due to the trigger edge 124 striking the second step surface 136, a vibration transmits through the archery release assembly 100, which the user can feel when grasping the archery release assembly 100. In an example of yet another embodiment, due to the trigger edge 124 striking the second step surface 136, such sound and such vibration are generated as the output experienced by the user. The output generated by the trigger edge 124 striking the second step surface 136 provide useful feedback to the user. In response to receiving or perceiving this output, the user can prepare for the shooting event, which can include finalizing the user's aiming, controlling the user's breathing, adjusting the user's posture, or carrying out other shooting preparation or optimization steps.

Figure 1:
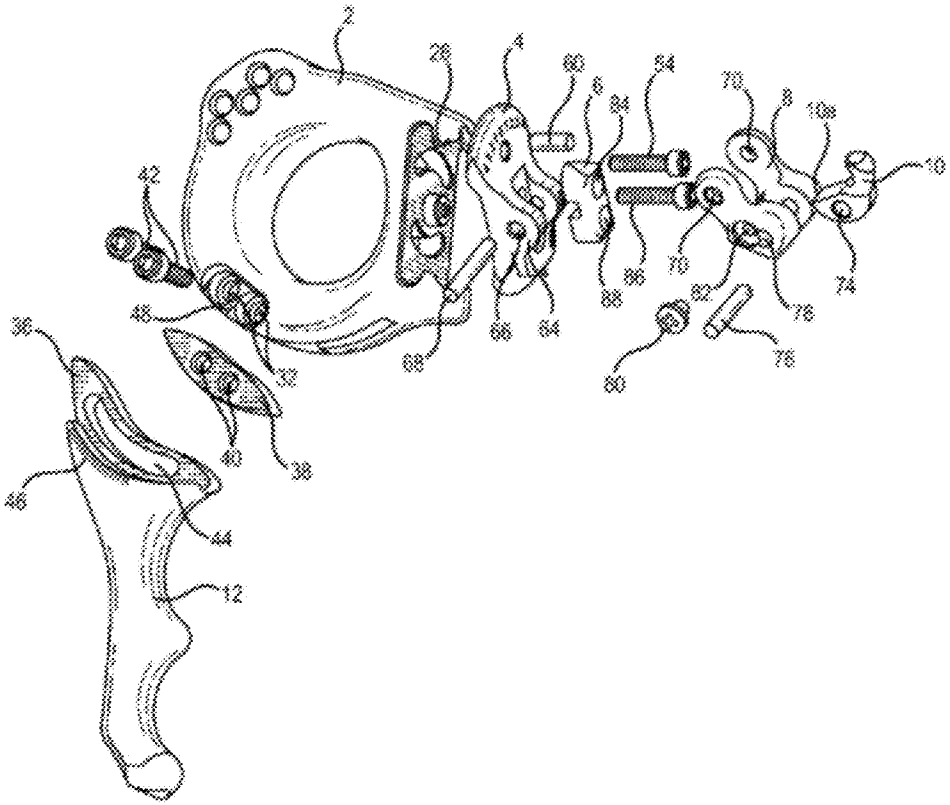
Prior Art FIG. 1
FIG. 1 is an exploded isometric side view of the prior art archery release device disclosed in U.S. Pat. No. 8,622,051.

In contrast to the prior art release aid (shown in FIG. 1), the archery release assembly 100 achieves the output production without causing additional strikes to or physical interaction with the draw cord holder 150. This provides an important improvement by helping to preserve the life and integrity of the draw cord holder 150. In an embodiment, the interaction between the trigger 120 and the step-shape portion 131*a* also results in lower load forces on the interfacing elements in comparison to load forces that would have been generated at an interface with the draw cord holder 150. As a result, the interfacing elements of the trigger 120 and the sear or trigger controller 130 wear more slowly and have an overall longer lifespan. Generating the output through the interaction between components other than the draw cord holder 150, such as the trigger 120 and the step-shape portion 131*a*, increases design flexibility of the archery release assembly 100 itself. For example, design approaches may be explored that are isolated or separate from the movement of the draw cord holder 150. In an embodiment, the archery release assembly 100 generates the output with less delay than the prior art release aid shown in FIG. 1. This is because, in the sequence of force events that begin with the user's force on the trigger grasp 129 and ends with the draw cord 5 sliding off of the draw cord holder 150, the output occurs earlier in the sequence than in the prior art release aid. Also, the generator of the output (the trigger edge 124 striking the second step surface 136) is located closer to the user 101, which reduces the time necessary for the sound waves of the output to travel to the user 101. By receiving the output with less delay, the user has the advantage of having more time for the shooting preparation and optimization steps described above.

Figure 11:
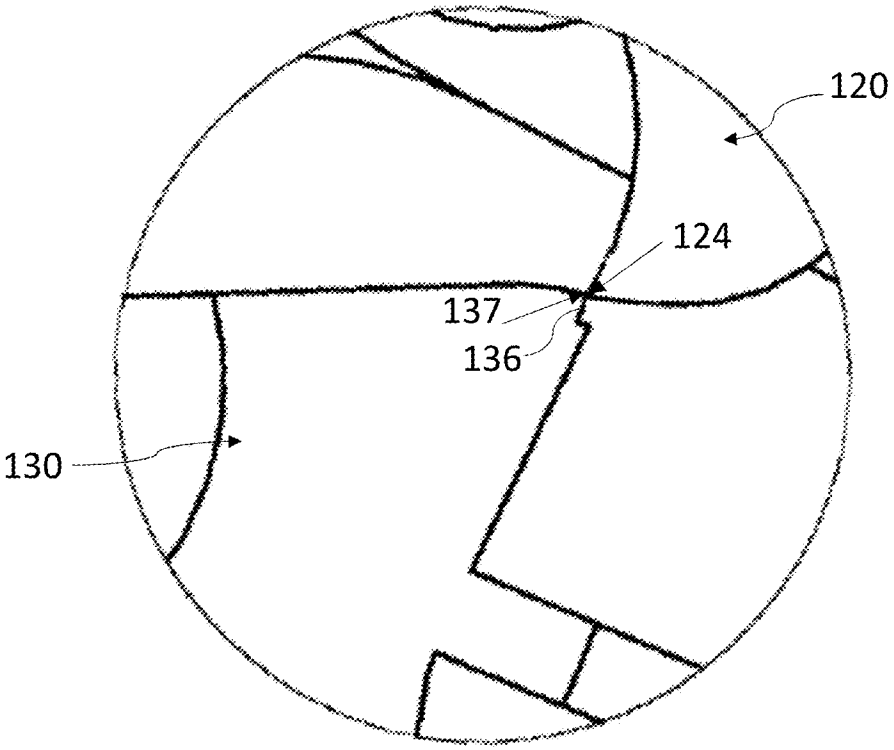
FIG. 11 is a close-up, enlarged view of a portion of the archery release assembly of FIG. 2, showing a fourth interaction between the trigger and the trigger controller.
Figure 12:
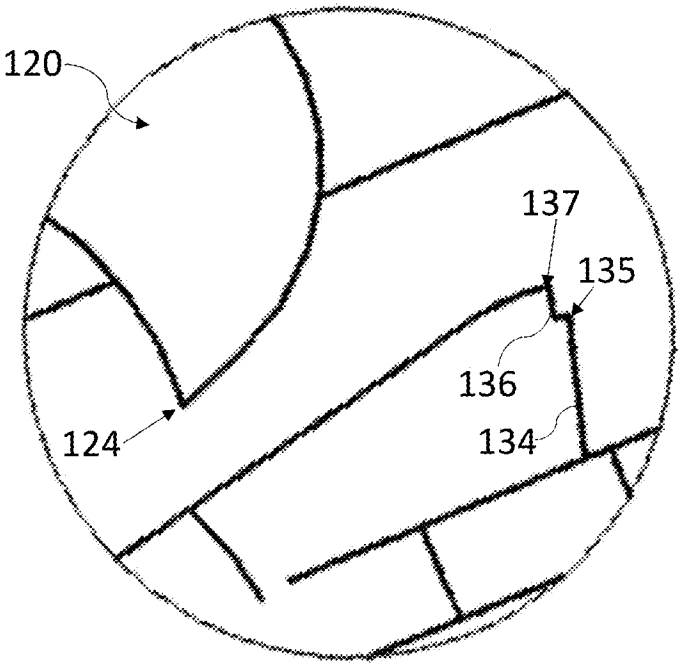
FIG. 12 is a close-up, enlarged view of a portion of the archery release assembly of FIG. 2, showing the trigger being disengaged from the trigger controller.

A fourth interaction or fourth release action is shown in FIG. 11 when further pivoting of the trigger 120 in the counterclockwise direction moves the trigger edge 124 along the second step surface 136 to the second step edge 137. In this fourth interaction, the sear or trigger controller 130 continues to interfere with and restrict the movement of the trigger 120, which continues to keep the archery release assembly 100 cocked. The fifth interaction or final release action is shown in FIG. 12, when the trigger 120 is caused to pivot further in the counterclockwise direction to move the trigger edge 124 past the second step edge 137 resulting in a disengagement of the trigger 120 and the trigger controller 130. Once disengaged from the trigger 120, the trigger controller 130 is free to pivot in a clockwise direction due to a biasing force applied by one or more biasing elements, such as springs 102 (shown in FIG. 3). Pivoting the trigger control 130 in the clockwise direction results in the link 160 pivoting in the counterclockwise direction, which disengages the second link portion 164 from the draw cord holder 150. The draw cord holder 150 is then free to pivot relative to the body 110, as a result of the force exerted on the first draw cord holder portion 154 by the portion of the draw cord 50, to release the portion of the draw cord 50 and transition the archery release assembly 100 to the release position.

A biasing force may be exerted on one or more of the components discussed above by one or more biasing elements 102, 104, 106, 108 (shown in FIG. 3), such as springs. The biasing force may aid in pivoting one or more of the components during the transition from the non-release or cocked position to the release position. As shown, the trigger pivot axis TPA, the link pivot axis LPA, the controller pivot axis CPA, and the holder pivot axis HPA are parallel to each other. In an embodiment, one or more of the trigger pivot axis TPA, the link pivot axis LPA, the controller pivot axis CPA, and the holder pivot axis HPA each extend along different planes.

The output generated when the trigger edge 124 moves from the first step edge 135 to the second step surface 136 is an indication to the user that the archery release assembly 100 is nearing the transition from the non-release or cocked position to the release position, helping to provide the user with time to brace for the shooting. As shown, the second step surface 136 has a relatively short run compared to the run provided by the first step surface 134 such that the transition may occur very soon after the output is produced. In other embodiments, the second step surface 136 may have a longer run to generally increase the amount of time between the generation of the output and the transition to the release position. The variability of the runs or runways of the first and second step surfaces 134, 136 enables the output of the archery release assembly 100 to be adjusted or customized for different types of users, different types of user preferences, or different types of archery events (e.g., competition shooting or hunting shooting).

The parts, components, and structural elements of the archery release assembly 100 (and each of its parts) can be combined into an integral or unitary, one-piece object through welding, soldering, plastic molding other methods, or such parts, components, and structural elements can be distinct, removable items that are attachable to each other through screws, bolts, pins and other suitable fasteners.

In the foregoing description, certain components or elements may have been described as being configured to mate with each other. For example, an embodiment may be described as a first element (functioning as a male) configured to be inserted into a second element (functioning as a female). It should be appreciated that an alternate embodiment includes the first element (functioning as a female) configured to receive the second element (functioning as a male). In either such embodiment, the first and second elements are configured to mate with, fit with or otherwise interlock with each other.

It should be understood that various changes and modifications to the embodiments described herein will be apparent to those skilled in the art. Such changes and modifications can be made without departing from the spirit and scope of the present disclosure and without diminishing its intended advantages. It is therefore intended that such changes and modifications be covered by the appended claims.

Although several embodiments of the disclosure have been disclosed in the foregoing specification, it is understood by those skilled in the art that many modifications and other embodiments of the disclosure will come to mind to which the disclosure pertains, having the benefit of the teaching presented in the foregoing description and associated drawings. It is thus understood that the disclosure is not limited to the specific embodiments disclosed herein above, and that many modifications and other embodiments are intended to be included within the scope of the appended claims. Moreover, although specific terms are employed herein, as well as in the claims which follow, they are used only in a generic and descriptive sense, and not for the purposes of limiting the present disclosure, nor the claims which follow.

The following is claimed:

1. An archery release assembly comprising:

a body;

a trigger pivotally coupled to the body;

a trigger controller pivotally coupled to the body, the trigger controller comprising:
a first controller portion comprising:
a first step comprising a first edge; and
a second step comprising a second edge; and
a second controller portion;
a link pivotally coupled to the body, the link comprising:
a first link portion configured to engage the second controller portion; and
a second link portion; and
a draw cord holder pivotally coupled to the body, the draw cord holder being pivotal between a plurality of positions comprising:
a non-release position in which a part of the draw cord holder is engaged with the second link portion, enabling the draw cord holder to retain a portion of a draw cord; and
a release position in which the part of the draw cord holder is disengaged from the second link portion, enabling the portion of the draw cord to be released,
wherein the archery release assembly is configured to generate an output as a result of the trigger coming into contact with the first controller portion of the trigger controller, and
wherein while the draw cord holder is in the non-release position, a segment of the trigger is configured to:
move along the first step toward the first edge;
move from the first step edge to the second step; and
move along the second step to the second edge.

2. The archery release assembly of claim 1, wherein the output comprises at least one of an audible output, a sound output, a visual output, a vibratory output, a tactile output, or a haptic output.

3. The archery release assembly of claim 1, wherein to transition the draw cord holder to the release position, the segment of the trigger is configured to move over the second edge of the trigger controller causing:
the trigger to disengage from the trigger controller;
the trigger controller to pivot away from a first end of the link; and
the draw cord holder to pivot into the release position.

4. The archery release assembly of claim 1, wherein the second controller portion comprises a protrusion configured to interact with the second link portion.

5. The archery release assembly of claim 1, further comprising one or more biasing elements configured to apply a biasing force to at least one of: (i) the trigger; (ii) the trigger controller; or (iii) the link.

6. The archery release assembly of claim 2, wherein the first step comprises a first step surface that extends along a first plane, and the second step comprises a second step surface that extends along a second plane that is parallel to the first plane, wherein the first plane and the second plane are off-set from each other.

7. The archery release assembly of claim 1, wherein the trigger controller further includes a positioner configured to extend from the body and be grasped by a user.

8. An archery release assembly comprising:
a body;
a trigger supported by the body, wherein the trigger is pivotal relative to the body;
a trigger controller supported by the body, wherein the trigger controller is pivotal relative to the body, wherein the trigger controller comprises a step-shaped portion; and
a draw cord holder supported by the body,
wherein the trigger and the trigger controller are configured to cooperate to generate an output as a result of a part of the trigger coming into contact with the step-shaped portion of the trigger controller,
wherein the step-shaped portion of the trigger controller comprises:
a first step comprising a first step edge; and
a second step comprising a second step edge; and
wherein while the draw cord holder is in a non-release position, a segment of the trigger is configured to:
move along the first step toward the first step edge of the step-shaped portion;
move from the first step edge to the second step of the step-shaped portion; and
move along the second step to the second step edge of the step-shaped portion.

9. The archery release assembly of claim 8, wherein:
the output comprises at least one of an audible output, a sound output, a visual output, a vibratory output, a tactile output, or a haptic output; and
the trigger and the trigger controller are configured to cooperate so that:
in a first position, the part of the trigger is engaged with the step-shaped portion of the trigger controller;
in a second position, the part of the trigger is disengaged from the step-shaped portion of the trigger controller; and
before reaching the second position, the part of the trigger is configured to strike the step-shaped portion, wherein the striking causes the output.

10. The archery release assembly of claim 8,
wherein the draw cord holder is configured to pivot relative to the body in response to the trigger controller disengaging from the trigger.

11. The archery release assembly of claim 10, wherein while the draw cord holder is in a non-release position, the trigger is configured to:
move a part of the trigger along the first step toward the first step edge;
move the part of the trigger from the first step edge to the second step; and
move the part of the trigger along the second step to the second step edge.

12. The archery release assembly of claim 10, wherein to transition the draw cord holder to a release position, the trigger is configured to move a part of the trigger over the second step edge of the trigger controller causing:
the trigger to disengage from the trigger controller; and
the draw cord holder to pivot into the release position.

13. The archery release assembly of claim 10, wherein the first step-shaped portion comprises a first step surface that extends along a first plane, and the second step-shaped portion comprises a second step surface that extends along a second plane that is parallel to the first plane, wherein the first plane and the second plane are spaced apart from each other.

14. The archery release assembly of claim 8, further comprising one or more biasing elements configured to apply a biasing force to at least one of: (a) the trigger; or (b) the trigger controller.

15. A method of manufacturing an archery release assembly, the method comprising:
providing a body;
pivotally coupling a trigger to the body;
structuring a trigger controller to comprise a step-shaped portion including;
a first step including a first step edge; and a second step including a second step edge;

pivotally coupling the trigger controller to the body; and pivotally coupling a draw cord holder to the body, wherein the trigger and the trigger controller are configured to cooperate to generate an output as a result of a part of the trigger striking the step-shaped portion of the trigger controller wherein while the draw cord holder is in a non-release position, a segment of the trigger is configured to:

move along the first step toward the first step edge;

move from the first step edge to the second step; and move along the second step to the second step edge.

16. The method of claim 15, further comprising structuring the output to comprise at least one of an audible output, a sound output, a visual output, a vibratory output, a tactile output, or a haptic output.

17. The method of claim 15, wherein the draw cord holder is configured to pivot relative to the body in response to the trigger controller disengaging from the trigger.

18. The method of claim 17, further comprising structuring the trigger such that, while the draw cord holder is in a non-release position, the trigger is configured to:

move a part of the trigger along the first step toward the first step edge;

move the part of the trigger from the first step edge to the second step; and move the part of the trigger along the second step to the second step edge.

19. The method of claim 15, further comprising structuring the trigger to move the part of a trigger over the second step edge of the trigger controller causing:

the trigger to disengage from the trigger controller; and the draw cord holder to pivot into a release position.

20. The method of claim 15, further comprising structuring:

the first step to comprise a first step surface that extends along a first plane:

the second step to comprise a second step surface that extends along a second plane that is parallel to the first plane; and the first plane and the second plane to be off-set from each other.

* * * * *